US007690587B2

(12) United States Patent
Cooke

(10) Patent No.: US 7,690,587 B2
(45) Date of Patent: Apr. 6, 2010

(54) DAMPING ARRANGEMENT FOR A FUEL INJECTOR

(75) Inventor: Michael P. Cooke, Kent (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/725,463

(22) Filed: Mar. 19, 2007

(65) Prior Publication Data

US 2007/0215716 A1 Sep. 20, 2007

(30) Foreign Application Priority Data

Mar. 20, 2006 (EP) ..... 06251471

(51) Int. Cl.
*B05B 1/08* (2006.01)

(52) U.S. Cl. ..... 239/102.2; 239/533.4; 239/584

(58) Field of Classification Search ..... 239/102.2, 239/533.4, 533.5, 858.1, 585.4, 585.5, 900, 239/584

See application file for complete search history.

(56) References Cited

U.S. PATENT DOCUMENTS

| | | | | |
|---|---|---|---|---|
| 6,422,210 | B1 | 7/2002 | Lambert et al. | |
| 6,626,371 | B1 * | 9/2003 | Boecking | 239/96 |
| 6,776,354 | B2 * | 8/2004 | Cooke | 239/102.2 |
| 7,258,283 | B2 * | 8/2007 | Heinz et al. | 239/88 |
| 2002/0014540 | A1 | 2/2002 | Cooke | |
| 2006/0255184 | A1 | 11/2006 | Kanne et al. | |

FOREIGN PATENT DOCUMENTS

| | | |
|---|---|---|
| DE | 103 26 259 | 1/2005 |
| EP | 0890736 | 1/1999 |
| EP | 1079095 | 2/2001 |
| EP | 1174615 | 1/2002 |
| EP | 1 571 328 | 9/2007 |
| JP | 2005-201271 | 7/2005 |

OTHER PUBLICATIONS

Translated Japan Office Action dated Oct. 8, 2009.

* cited by examiner

*Primary Examiner*—Christopher S Kim
(74) *Attorney, Agent, or Firm*—Thomas N. Twomey

(57) ABSTRACT

A fuel injector for use in an internal combustion engine, the fuel injector comprising: a valve needle which is engageable with a valve needle seat to control fuel injection through an injector outlet; an actuator arrangement arranged to control fuel pressure with in a control chamber, a surface associated with the valve needle being exposed to fuel pressure with in the control chamber such that fuel pressure variations within the control chamber control movement of the valve needle relative to the valve needle seat; damping means for damping opening movement of the valve member, the damping means comprising a damper chamber and the damping means being arranged such that fuel pressure variations within the damper chamber damp opening movement of the valve member wherein the damping means is arranged such that in use there is a through flow of fuel through the damper chamber.

13 Claims, 5 Drawing Sheets

DAMPING ARRANGEMENT FOR A FUEL INJECTOR

The present invention relates to a fuel injector for use in the delivery of fuel to a combustion space of an internal combustion engine. In particular, the invention relates to fuel injectors having damping arrangements for the control of injector needle.

In a known piezoelectrically actuated fuel injector, a piezoelectric actuator is operable to control the position occupied by a control piston, the piston being moveable to control the fuel pressure within a control chamber defined by a surface associated with the valve needle of the injector and a surface of the control piston. The piezoelectric actuator includes a stack of piezoelectric elements, the energisation level, and hence the axial length, of the stack being controlled by applying a voltage across the stack. Upon de-energisation of the piezoelectric stack, the axial length of the stack is reduced and the control piston is moved in a direction which causes the volume of the control chamber to be increased, thereby causing fuel pressure within the control chamber to be reduced. The force applied to the valve needle due to fuel pressure in the control chamber is therefore reduced, causing the valve needle to lift away from a valve needle seating so as to permit fuel delivery into the associated engine cylinder.

In order to cause initial movement of the valve needle away from its seating, a relatively large retracting force must be applied to the valve needle. In known piezoelectrically actuated fuel injectors, the large retracting force applied to the valve needle is maintained throughout opening movement of the valve needle to its full lift position.

The Applicant's co-pending application EP1174615 describes such a "de-energise to inject" fuel injector. The injector described therein includes a damping arrangement in which a restricted flow path between the control chamber and a further chamber serves to damp opening movement of the valve needle by restricting the rate of flow of fuel from the control chamber as a retracting force is applied to the piston member.

A disadvantage of such an arrangement is that if heavy damping is required the fuel in the control volume can undergo significant heating which changes its bulk modulus and viscosity characteristics. This potentially can lead to a hysteresis effect in the injector's performance or alternatively may require the damping to be limited to lower levels than required for the best needle lift control.

It is therefore an object of the present invention to provide a fuel injector which overcomes or substantially alleviates this problem.

According to a first aspect of the present invention, there is provided a fuel injector for use in an internal combustion engine, the fuel injector comprising: a valve needle which is engageable with a valve needle seat to control fuel injection through an injector outlet; an actuator arrangement arranged to control fuel pressure within a control chamber, a surface associated with the valve needle being exposed to fuel pressure within the control chamber such that fuel pressure variations within the control chamber control movement of the valve needle relative to the valve needle seat; damping means for damping opening movement of the valve needle, the damping means comprising a damper chamber and the damping means being arranged such that fuel pressure variations within the damper chamber damp opening movement of the valve needle wherein the damping means is arranged such that in use there is a through flow of fuel through the damper chamber.

The present invention provides for a fuel injector comprising an injector needle, the position of which is controlled by fuel pressure variations in a control chamber. The fuel pressure in the control chamber is, in turn, controlled by an actuator arrangement.

A damping means is also provided for damping the opening motion of the valve needle. The damping means comprises a damper chamber which is also exposed to fuel pressure variations. These fuel pressure variations provide damping for the opening motion of the valve needle.

It is noted that the damper chamber and control chamber are separate chambers. This allows the damper chamber to be arranged such that there is a through flow of fuel through the damper chamber. This ensures that the fuel within the damper chamber does not undergo excessive heating during operation of the fuel injector and therefore ensures that the problems associated with the prior art, namely changes in bulk modulus and viscosity changes, are substantially overcome.

Conveniently, the damping means can be arranged such that the closing of the valve needle is substantially undamped. This allows the valve needle to be quickly closed.

As an alternative, the damping means may provide two way damping for both needle opening and needle closing.

Conveniently, the fuel injector comprises a sleeve member which partially or fully encloses components of the injector. The sleeve member is in communication with the actuator arrangement such that movement of the actuator is transmitted to the sleeve member. The sleeve member will co-operate with the actuator arrangement such that a retracting force applied to the sleeve by the actuator arrangement will cause the valve needle to move away from its seating. Such an arrangement corresponds to a "de-energise" to inject injector.

Preferably, the actuator arrangement comprises a stack of piezoelectric elements. These elements being co-operable with the sleeve member so as to apply the retracting force to the sleeve member upon the axial length of the stack being reduced.

Conveniently, the damper chamber is in fluid communication with a source of pressurised fuel by means of a restricted orifice in the sleeve member. This restricted (or damping) orifice restricts the flow of fuel into the damper chamber and therefore provides a mechanism for damping the lifting of the valve needle.

Conveniently, the actuator is housed within an accumulator volume, the accumulator volume being in communication with the source of pressurised fuel. Therefore, preferably, the restricted orifice from the damper chamber is in fluid communication with the accumulator volume.

Conveniently, the sleeve member defines in part both the damper chamber and the control chamber. It is noted however that the damper chamber and control chamber are not in direct fluid communication with one another.

Preferably, the fuel injector further comprises a spring chamber which is also defined, in part, by the sleeve member. Such a spring chamber, if present, comprises a number of spring members to bias various components of the fuel injector into position.

Conveniently, the control and damper chambers are separated by a combination of a radially extending wall member within the sleeve member and a piston member which is in communication with the valve needle and which passes through part of the wall member.

The sleeve member may comprise a wall member that extends into the sleeve bore. This wall member may be integrally formed with the sleeve member or alternatively may be a separate component that is welded or glued to the sleeve member or is provided as an interference fit with the sleeve member.

The wall member essentially divides the bore within the sleeve member. The chamber defined between the wall member and the valve needle is the control chamber. The surface of the wall member on the other side of the wall member from the control chamber defines, in part, the damper chamber.

The injector, as noted above, may also conveniently comprise a piston member. A first portion of the piston member is in communication with the valve needle and passes through the wall member where it expands into a second region of enhanced diameter. The volume defined between the second region of the piston member, the wall member and the sleeve member is the damper chamber. The wall member and piston member together provide a fluid tight seal within the sleeve bore which separates the control and damper chambers.

Conveniently, the piston member passes through a bore in the wall member and is slidable therein in response to movements of the valve needle as the fluid pressure within the injector varies in use.

The spring chamber is defined by the piston member, the sleeve member and the base of the actuator arrangement. The piston member may provide a fluid tight seal between the spring and damper chambers. Alternatively, the fuel injector may further comprise a valve member which is operable between a seated position in which it blocks fluid flow from the damper chamber to the spring chamber and an unseated position in which fluid can flow from the damper chamber to the spring chamber. Conveniently, a first spring in the spring chamber biases the valve member towards its seated position.

Conveniently, the valve member may be provided as an annular valve member that is in close communication with the bore of the sleeve member. In its seated position such an annular valve member forms a fluid tight seal between the inside of the sleeve bore and the piston member. In its unseated position, fluid is able to flow around the piston member and through the centre of the annular valve member into the spring chamber.

Preferably, the spring chamber comprises a vent passage (or passages) providing a flow path from the spring chamber to the source of pressurised fuel. When the valve member is in its unseated position such a vent passage provides a flow path from the damper chamber to the fuel source (or accumulator volume) in addition to the flow path provided by the restricted orifice(s). In other words, the spring chamber and valve means arrangement is arranged such that, during needle closure, there is a flow path from the damper chamber to the fuel source via the vent passage.

The valve member may be arranged such that during valve needle closure the pressure within the damper chamber is sufficient to unseat the valve member and open up the flow path via the vent passage. This allows the fluid within the damper chamber to be refreshed and also provides for substantially undamped valve needle closure.

The spring chamber may comprise a second spring member to urge the piston member against the valve needle.

In order to allow the control chamber to track fast changes in the rail pressure of the system the control chamber may be connected to the source of fuel (accumulator volume) by a small orifice. Such an orifice also provides a mechanism for fast auto-closure of the valve needle in the event of faults in the actuator arrangement or associated drive circuit.

In order that the invention may be more readily understood, reference will now be made, by way of example, to the accompanying drawings in which.

Figure 1:
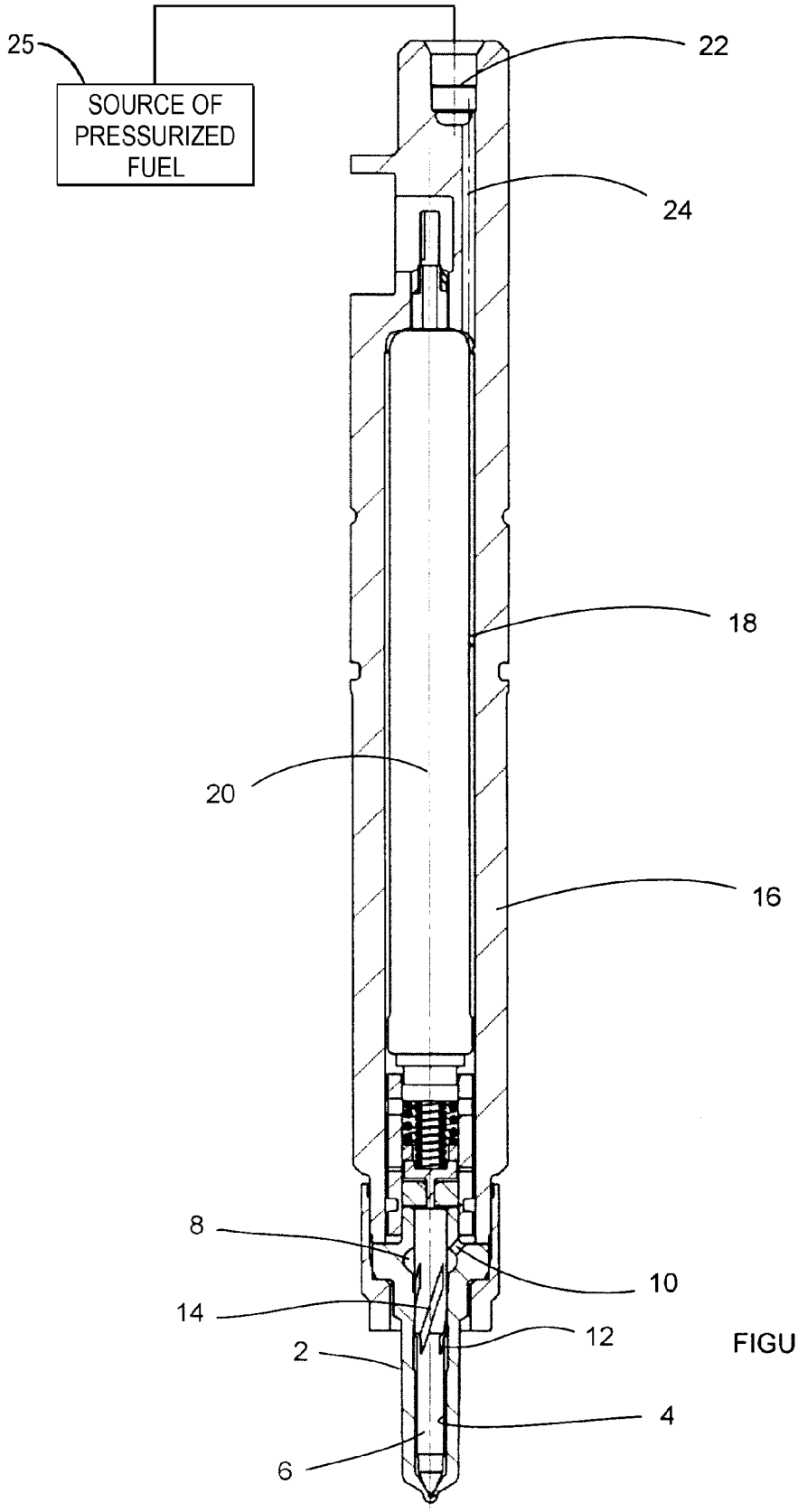
FIG. 1 is a sectional view of an embodiment of the present invention.

Referring to FIG. 1, the fuel injector includes a nozzle body 2 provided with a blind bore 4 within which a valve needle or valve member 6 is slidable. The lower end of the valve needle 6 is shaped to be engageable with a valve seating defined by the blind end of the bore 4 to control fuel delivery through outlet openings (not shown), provided in the nozzle body 2.

An enlarged region of the bore 4 defines an annular chamber 8 which communicates with a supply passage 10 for fuel defined, in part, within the nozzle body 2, the supply passage 10 communicating with a source of pressurised fuel, for example the common rail of a common rail fuel system. In use, fuel delivered to the annular chamber 8 through the supply passage 10 is able to flow to a delivery chamber 12 defined between the valve needle 6 and the bore 4 by means of flats, slots or grooves 14 provided on the surface of the valve needle 6. Engagement of the valve needle 6 with its seating prevents fuel within the delivery chamber 12 flowing past the seating and out through the outlet openings provided in the nozzle body 2. When the valve needle 6 is moved away from its seating, fuel within the delivery chamber 12 is able to flow past the seating, through the outlet openings and into an engine cylinder or other combustion space. The valve needle 6 is provided with one or more thrust surfaces (not shown in FIG. 1), fuel pressure within the delivery chamber 12 acting on the thrust surfaces to urge the valve needle 6 away from its seating. By controlling the force on the valve needle 6 which opposes the upward force acting on the thrust surfaces, movement of the valve needle 6 away from its seating can be controlled, as will be described in further detail hereinafter.

The end of the nozzle body 2 remote from the outlet openings is in abutment with an actuator housing 16 for a piezoelectric actuator arrangement, the piezoelectric actuator arrangement being arranged to control movement of the valve needle 6 within the bore 4, in use. The actuator housing 16 defines an accumulator volume 18 for receiving fuel at high pressure. A stack 20 of piezoelectric elements, forming part of the actuator arrangement, is arranged within the accumulator volume 18. As can be seen in FIG. 1, the actuator housing 16 includes an inlet region 22 provided with a drilling 24 forming part of a supply passage for fuel flowing from the inlet region 22 to the nozzle body 2. The inlet region 22 and the drilling 24 are arranged such that, in use, fuel is supplied through the inlet region 22, through the drilling 24 and into the accumulator volume 18 for delivery to the supply passage 10 defined within the nozzle body 2. The inlet region 22 houses an edge filter member (not shown in FIG. 1) which serves to remove particulate contaminants from the flow of fuel to the injector, in use, thereby reducing the risk of damage to the various components of the injector.

Figure 2:
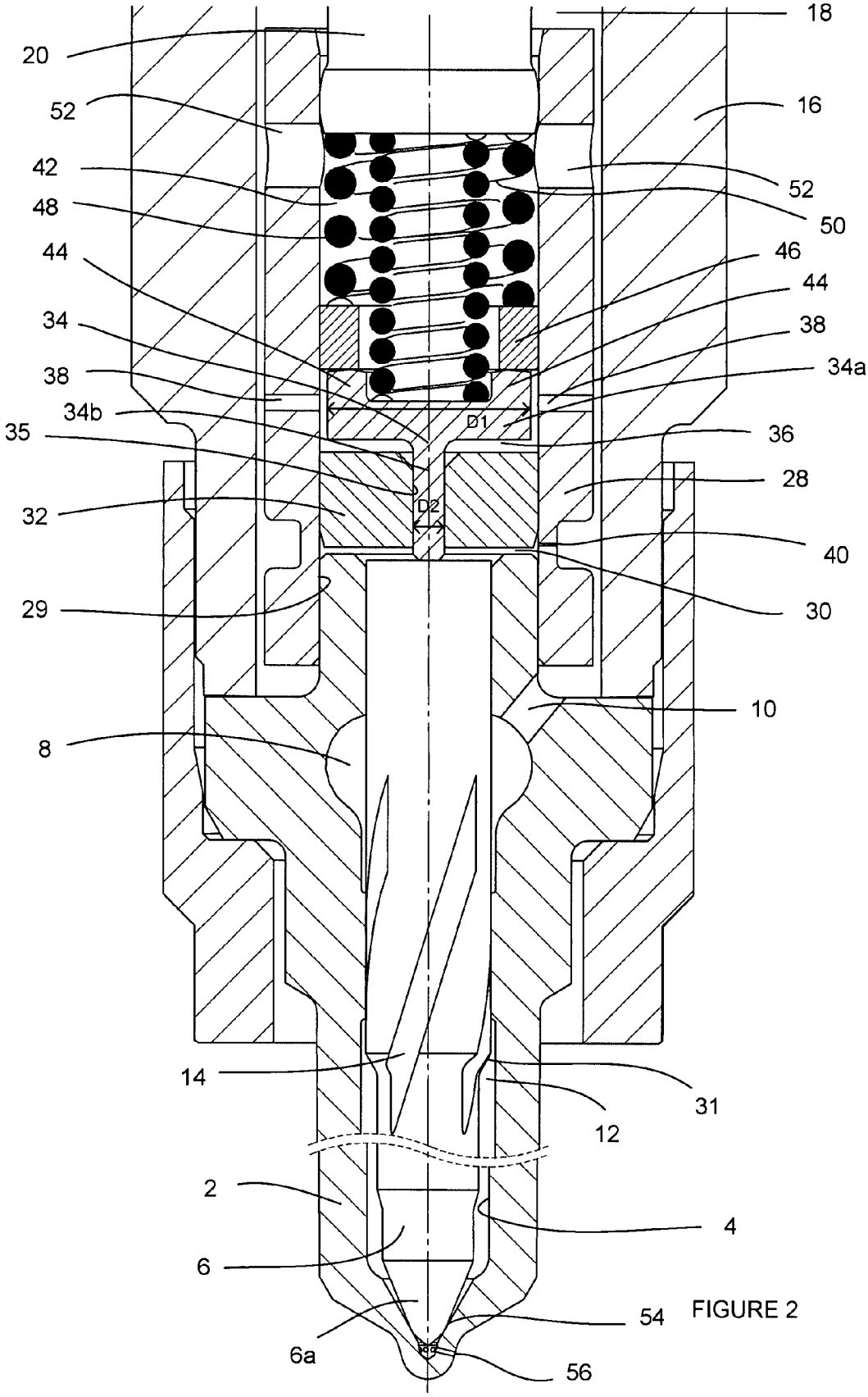
FIG. 2 is an enlarged sectional view of a part of the fuel injector in FIG. 1.

FIG. 2 is an enlarged sectional view of the lower half of FIG. 1. Like numerals have been used to denote like features.

The top end of the injector body 2 is surrounded by a sleeve 28 which defines a bore 29. The sleeve 28 moves axially in response to movement of the actuator arrangement. A control chamber 30 is defined by the top end of the nozzle body 2, the top of the needle 6, the sleeve 28 and a wall member fixed to the inside of the sleeve 28.

As shown in FIG. 2, the wall member 32 is a separate component. Alternatively, it could be integrally formed with the sleeve 28. In the instance that the wall member 32 is a separate component it may be fixed to the sleeve 28 by an interference fit, glue or welds such that it moves axially with the sleeve 28.

A piston 34 having an upper region 34*a* with a diameter $D_1$ (as shown in FIG. 2) and a lower region 34*b* with a diameter $D_2$ abuts the top of the needle 6. The lower region 34*b* of the piston extends through a bore 35 in the wall member 32. The upper region 34*a* of the piston, the sleeve 28 and the wall member 32 define a damper chamber 36. It is noted that there is no direct fluid path between the control chamber 30 and the damper chamber 36. The upper region 34*a* of the piston 34 is not a close fit to the sleeve 28.

The damper chamber 36 is connected to the accumulator volume 18 by means of damping orifices 38 in the sleeve. The control chamber 30 is connected to the accumulator volume 18 by means of a restricted passage 40 in the sleeve.

The base of the stack 20, the sleeve 28 and the top of the piston 34 define a spring chamber 42. The top surface of the upper region 34*a* of the piston is provided with an annular ridge 44 and a damper valve 46 sits on top of the ridge 44. The damper valve is of annular construction and is held against the piston 34 by a spring 48 within the spring chamber 42.

A further spring 50 is provided within the spring chamber 42 and passes through the annular damper valve 46 to act directly upon the piston member 34.

The spring chamber 42 is in communication with the accumulator volume 18 via vent passages 52.

In the needle 6 position shown in FIG. 2 it can be seen that the needle tip 6*a* is engaged with its valve seating 54 such that fuel is unable to pass from the delivery chamber 12 out of the outlets 56 to the combustion area.

In use, fuel under high pressure is supplied through the inlet region 22 to the accumulator volume 18 and is able to flow into the control chamber 30 through the restricted passage 40. Fuel pressure within the control chamber 30 applies a force to the valve needle 6 which acts against a force due to fuel pressure within the delivery chamber 12 acting on the thrust surfaces 31 of the valve needle 6 (the needle 12 is therefore hydraulically coupled to actuator movement). By controlling the axial length of the piezoelectric stack 20, and hence movement of the sleeve member 28, the net force acting on the valve needle 6 can be controlled so as to permit injection through the outlet openings of the injector during the required stages of operation.

Figure 3:
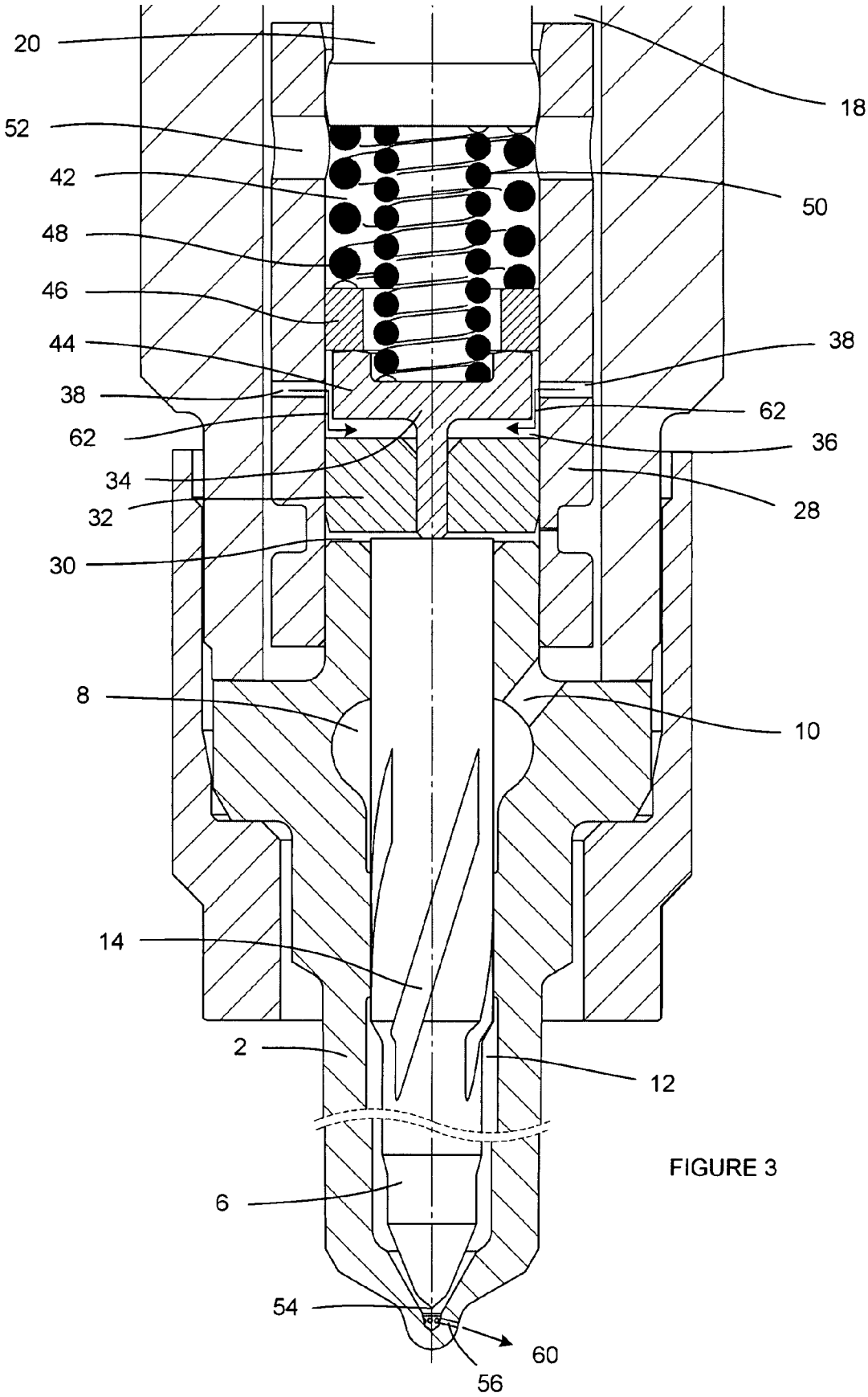
FIG. 3 is a sectional view of the fuel injector of FIGS. 1 and 2 as the injector needle lifts from its seat.
Figure 4:
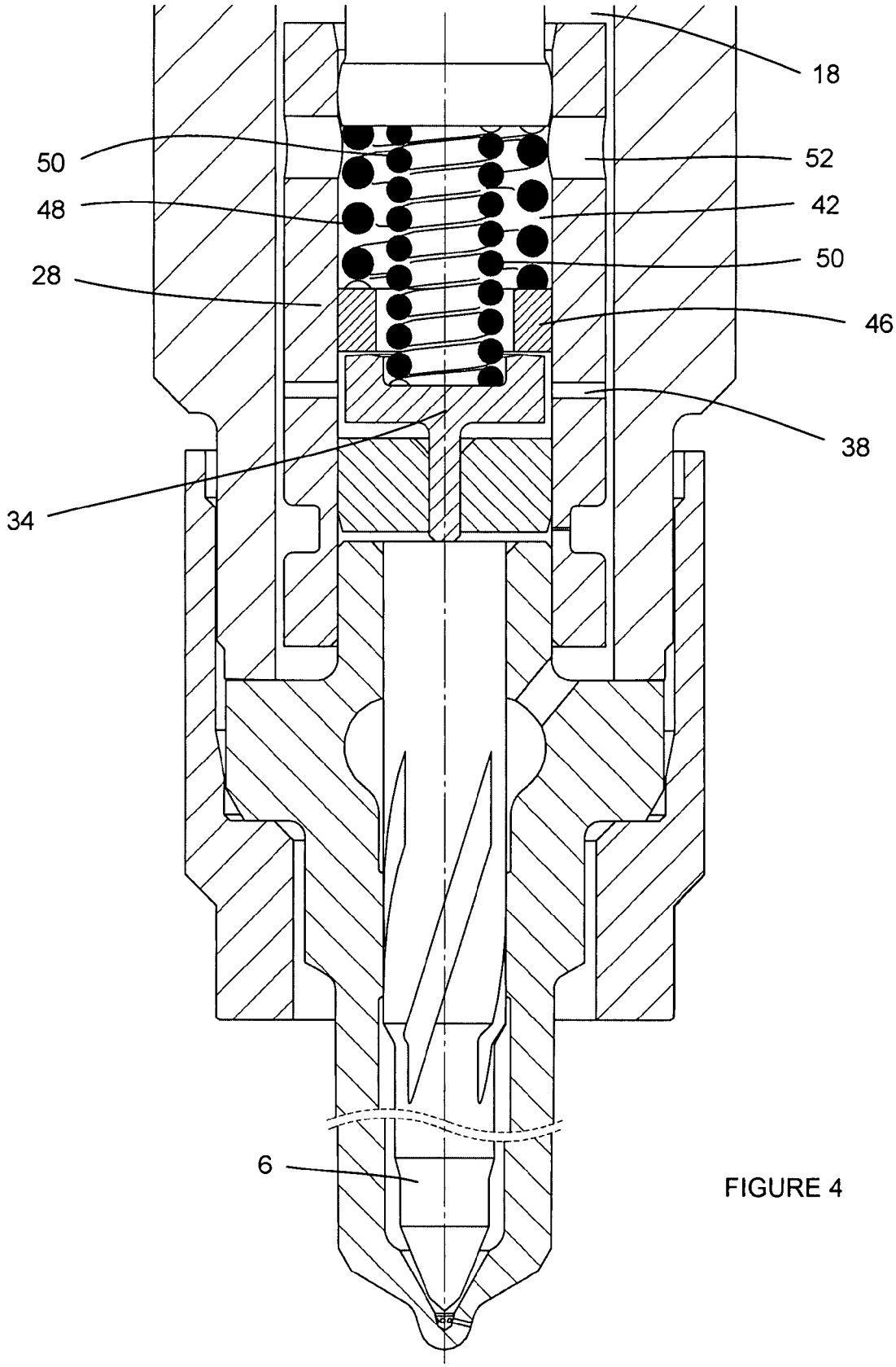
FIG. 4 is a sectional view of the fuel injector of FIGS. 1 and 2 as the injector needle returns to its seat from the raised position shown in FIG. 3.
Figure 5:
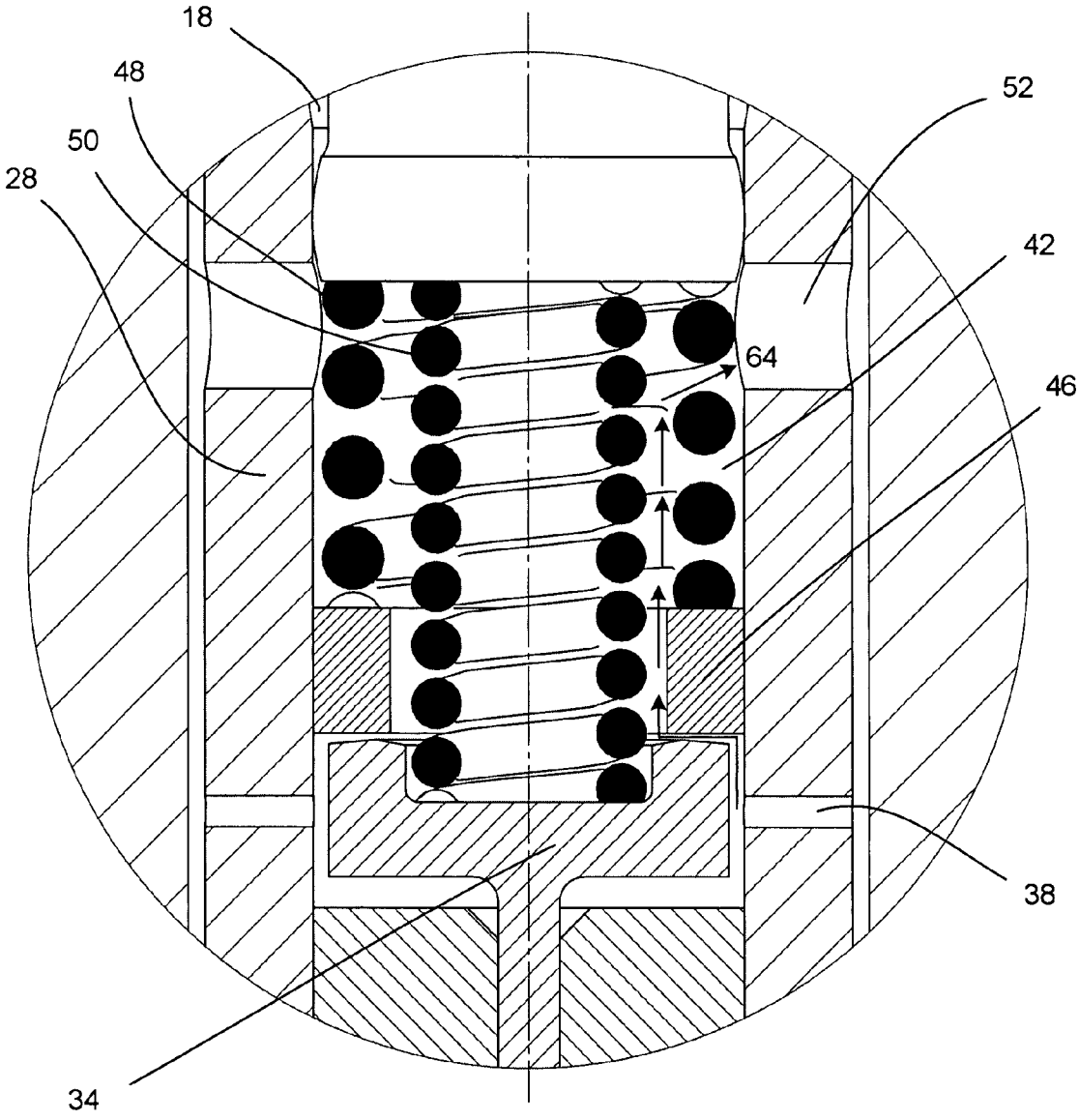
FIG. 5 is an enlarged view of part of the injector shown in FIG. 4.

Operation of the fuel injector will now be explained with reference to FIGS. 3 to 5. FIG. 3 shows the fuel injector as the needle 6 lifts from its seating 54. FIG. 4 shows the situation as the needle 6 returns to its seating and FIG. 5 shows an enlarged view of the damper chamber 36 and spring chamber 42 from FIG. 4. It is noted that like numerals have been used to denote like features throughout the Figures.

FIG. 3 shows the operation of the fuel injector as the needle 6 lifts. In use, the actuator arrangement (in this case the piezoelectric stack 20) de-energises and contracts. This in turn pulls the sleeve 28 back (i.e. the sleeve moves upwards as shown in the Figures). The wall member 32 (which is either integrally formed with the sleeve 28 or a separate component which moves axially with the sleeve 28) moves with the sleeve 28 such that the volume of the control chamber 30 increases.

As the volume of the control chamber 30 increases the pressure in the chamber drops. To compensate for the drop in pressure the needle 6 lifts from its seating 54. Fuel can now flow from the delivery chamber 12 past the seating 54, through the outlet openings 56 and into an engine cylinder or other combustion space (as indicated by arrow 60 in FIG. 3).

The difference in diameters of the sleeve 28 and the needle 6 means that the needle lifts further than the sleeve. This difference in the relative movement of the needle 6 and sleeve 28 means that the piston 34 (ridges 44) acts on the damper valve 46 such that the valve 46 is pushed upwards.

As the wall member 32 moves with the sleeve 28, the volume of the damper chamber 36 increases as the damper valve 46 is pushed upwards.

The increase in volume of the damper chamber 36 results in a drop in pressure within the chamber. To compensate, fuel from the accumulator volume 18 enters the damper chamber 36 via the passages 38. This inward flow of fuel is indicated by arrows 62.

The drop in pressure within the chamber 36 and the inward flow of fuel from the accumulator volume 18 provide a damping mechanism which damps the lifting of the valve needle.

It is noted that if the needle is closed slowly from the position shown in FIG. 3 then fuel within the damper chamber 36 will flow back into the accumulator volume via the passages 38. In the event that it is required to drop the needle quickly and close the fuel path to the outlets 56 then the mode of operation is as described below in relation to FIGS. 4 and 5.

Turning now to FIGS. 4 and 5 the mode of operation of the fuel injector when the needle is closed quickly is now described. FIG. 5 shows an enlarged view of part of FIG. 4.

When the actuator is energised, i.e. as the stack of piezoelectric elements is energised, the sleeve 28 will be pushed downwards (as, in the case of the piezoelectric actuator, the piezoelectric elements increase in length). The movement of the needle 6 is therefore reversed compared to the description above in relation to FIG. 3. The inner spring 50 exerts a downward force on the piston 34 such that the piston tracks the downward movement of the sleeve 28. The piston 34 moves further than the sleeve 28 and consequently the damper chamber 36 decreases in volume.

As the volume of the damper chamber 36 decreases, the pressure within the chamber increases. If the actuator arrangement is being operated such that the needle closes quickly then the pressure in the chamber 36 will build sufficiently such that the damper valve 46 lifts off of the piston 34 against the action of the spring 48.

As the damper valve 46 lifts, an additional fuel flow path from the damper chamber 36 to the accumulator volume 18 opens up. This additional flow path allows fuel to flow around the piston 34, through the gap between the damper valve 46 and the piston 34 and through the centre of the annular damper valve 46 into the spring chamber 42. The spring chamber 42 is in fluid communication with the accumulator volume via the vent passages 52. The additional flow path is indicated on FIG. 5 by arrows 64.

Since the vent passages 52 are of larger diameter than the orifices 38 fuel can flow freely from the damper chamber 38 back into the accumulator volume 18 as the needle 6 is closed. It is noted that fuel will also flow back to the accumulator volume 18 via the damping orifices 38 during needle closure.

The vent passage 52 arrangement described in relation to FIGS. 4 and 5 limits the damping pressure during needle closing and therefore allows the needle to be closed quickly. Opening of the needle 6 is however damped since these vent passages 52 are not in fluid communication with the damper chamber 36 during valve lifting—only the narrower orifices 38 allow fuel to enter the damper chamber 36 during valve opening.

When the needle closes and engages its seating, the spring 48 returns the damper valve member 46 into communication with the ridges 44 on the piston 34, thereby closing off the additional fuel flow path. This prevents excessive overshoot of the piezoelectric actuator stack as movement of the stack is damped as fuel is sucked back in through the orifices 38.

It is noted that there is a fluid path, via the damper orifices 38, between the damper volume 36 and the accumulator volume 18 at all times. During periods of rapid needle closure there is also an additional fluid flow path via the vent passage 52 from the damper chamber 36 to the accumulator volume. These flow paths allow fuel within the damper chamber 36 to be replaced by relatively cool fuel from the accumulator volume 18. The damping action of the injector according to the present invention does not therefore result in an excessive increase in fuel temperature in the damper chamber 36.

It is noted that if similar levels of damping are acceptable during needle lifting and closing then the inner spring 50 may be omitted, in which case the damper valve 46 will not open. Alternatively, the diameter of the upper portion 34*a* of the piston 34 may be increased to be a close fit with the sleeve 28 and the damper valve may be omitted.

It will be understood that the embodiments described above are given by way of example only and are not intended to limit the invention, the scope of which is defined in the appended claims. It will also be understood that the embodiments described may be used individually or in combination.

The invention claimed is:

1. A fuel injector for use in an internal combustion engine, the fuel injector comprising:

an inlet region for passing fuel to an accumulator volume, a valve needle, a valve needle seat, a control chamber, an actuator arrangement, an injector outlet, and damping means comprising a damper chamber for damping an opening movement of the valve needle;

the actuator arrangement comprising a sleeve member defining a bore having a longitudinal axis and defining a radially extending wall member fixedly coupled to the sleeve and further defining the bore, the sleeve member and wall member retracting longitudinally in response to a de-energisation of the actuator arrangement and causing the valve needle to move away from the valve seat;

the injector further comprising a piston member in communication with the valve needle, the piston member and wall member arranged to form a slidable fluid tight seal between the piston and the wall member within the bore, the control chamber being defined on one side of the fluid tight seal and the damper chamber being defined on the other side of the fluid tight seal;

the valve needle being engageable with the valve needle seat to control fuel injection through the injector outlet;

the actuator arrangement being arranged to control fuel pressure within the control chamber, a surface associated with the valve needle being exposed to fuel pressure within the control chamber such that fuel pressure variations within the control chamber control movement of the valve needle relative to the valve needle seat;

the damper chamber being in fluid communication with the accumulator volume via damping orifices, the damping means being arranged such that fuel pressure variations within the damper chamber damp the opening movement of the valve needle;

wherein the damping means is arranged such that as the opening movement of the valve needle occurs, whereby the valve needle lifts from its valve needle seat, there is a flow of fuel into the damper chamber only through the damping orifices, and as a closing movement of the valve needle occurs, there is a flow of fuel out of the damper chamber through the damping orifices and a vent passage such that in use there is a through flow of fuel through the damper chamber.

2. A fuel injector as claimed in claim 1, wherein the damping means is arranged such that the closing movement of the valve needle is substantially undamped.

3. A fuel injector as claimed in claim 1, wherein the actuator arrangement includes a stack of piezoelectric elements, the piezoelectric elements being cooperable with the sleeve member so as to apply the retracting force to the sleeve member upon the axial length of the piezoelectric stack being reduced.

4. A fuel injector as claimed in claim 1, wherein the control chamber is defined, in part, by the sleeve bore provided in the sleeve member.

5. A fuel injector as claimed in claim 1, wherein the damper chamber is defined in part by the sleeve bore provided in the sleeve member.

6. A fuel injector as claimed in claim 1, further comprising a spring chamber which is defined, in part, by the bore provided in the sleeve member.

7. A fuel injector as claimed in claim 1, wherein the sleeve member comprises a radially extending wall member and the injector further comprises: a spring chamber which is defined, in part, by the bore provided in the sleeve member; and a valve member operable between a seated position in which it abuts the piston member such that there is no fluid path between the damper chamber and the spring chamber and an unseated position in which a flow path is defined between the damper chamber and the spring chamber.

8. A fuel injector as claimed in claim 7, wherein the spring chamber comprises a first spring which is arranged to urge the valve member into its seated position.

9. A fuel injector as claimed in claim 7, wherein the valve member comprises an annular valve member which is in close contact with the bore of the sleeve member.

10. A fuel injector as claimed in claim 7, wherein the spring chamber comprises a vent passage which, when the valve member is in its unseated position, provides a flow path from the damper chamber to the accumulator volume.

11. A fuel injector as claimed in claim 7, wherein the spring chamber comprises spring which is arranged to urge the piston member against the valve needle.

12. A fuel injector as claimed in claim 1, further comprising restricted flow means for equalising pressure between the control chamber and the accumulator volume.

13. A fuel injector as claimed in claim 12, wherein the restricted flow means includes a restricted flow passage provided in the sleeve member, wherein the restricted flow passage fluidly connects the control chamber to the accumulator volume.

* * * * *